US008048205B2

(12) United States Patent
Schaub

(10) Patent No.: US 8,048,205 B2
(45) Date of Patent: Nov. 1, 2011

(54) LINT FILTER DEVICE AND METHOD FOR CLEANING A LINT FILTER DEVICE

(75) Inventor: Hartmut Schaub, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 772 days.

(21) Appl. No.: 12/084,875

(22) PCT Filed: Oct. 11, 2006

(86) PCT No.: PCT/EP2006/067267

§ 371 (c)(1),
(2), (4) Date: May 9, 2008

(87) PCT Pub. No.: WO2007/057260

PCT Pub. Date: May 24, 2007

(65) Prior Publication Data

US 2009/0158933 A1 Jun. 25, 2009

(30) Foreign Application Priority Data

Nov. 18, 2005 (DE) ..... 10 2005 055 179

(51) Int. Cl.
*B01D 46/00* (2006.01)

(52) U.S. Cl. ..... 95/277; 95/282; 96/414; 96/417; 96/429; 34/82; 34/85; 34/133; 34/155; 34/191; 55/351; 55/354

(58) Field of Classification Search ..... 95/282, 95/822; 55/227, 290, 293, 295, 302, 352, 55/431, 466, 470, 471; 96/417; 34/82, 85, 34/155, 133, 191

See application file for complete search history.

(56) References Cited

U.S. PATENT DOCUMENTS

| | | | | |
|---|---|---|---|---|
| 1,554,791 A | | 9/1925 | Cutter | |
| 3,304,624 A | * | 2/1967 | Czech | 34/82 |
| 4,435,909 A | * | 3/1984 | Williamson, Jr. | 34/82 |

FOREIGN PATENT DOCUMENTS

| | | |
|---|---|---|
| DE | 7117465 U | 10/1972 |
| DE | 82 24 528 U | 2/1983 |
| DE | 40 23 129 | 1/1992 |
| DE | 44 03 183 | 8/1995 |
| EP | 1 050 619 | 11/2000 |

OTHER PUBLICATIONS

Translation of EP 1050619 Nov. 8, 2000 (EP document filed with IDS of May 9, 2008).*
International Search Report PCT/EP2006/067267.

* cited by examiner

*Primary Examiner* — Duane Smith
*Assistant Examiner* — Karla Hawkins
(74) *Attorney, Agent, or Firm* — James E. Howard; Andre Pallapies

(57) ABSTRACT

A lint filter device for an airflow in a tumble dryer, comprising an endlessly circulating element, arranged around at least two deflector elements and positioned such as to be crossed by the airflow. The circulating element has an upper edge and a lower edge and first engaging elements are arranged on at least one of the two edges which, on opening a loading door of the tumble dryer may come to cooperate with at least one second engaging element, arranged inside the tumble dryer such that, on the opening process of the loading door, the circulating element may be automatically moved in a circulating direction and may be passed across at least one device for the removal of lint from the circulating element. The invention further relates to a method for cleaning such a lint filter device.

20 Claims, 2 Drawing Sheets

LINT FILTER DEVICE AND METHOD FOR CLEANING A LINT FILTER DEVICE

The present invention relates to a lint filter apparatus for an air flow in a tumble dryer with an endlessly circulating element, which is arranged so that it circulates around at least two deflector elements and is positioned in such a manner that it is crossed by the air flow, the circulating element having an upper edge and a lower edge. The invention also relates to an method for cleaning such a lint filter apparatus.

Many sorts of tumble dryers having lint filter apparatuses are known. However the cleaning of such a lint filter apparatus is usually very complex and still inadequate.

The German patent application DE 40 23 129 A1 discloses an electric tumble dryer, which has a coarse filter unit arranged in the region of a loading aperture with a fine filter unit arranged in a fixed position after the coarse filter unit. The coarse filter unit has to be taken out to remove the lint adhering to the fine filter unit. As it is taken out, a scraper, arranged on the coarse filter unit scrapes over the fine filter unit, thereby removing the lint adhering thereto. Cleaning and/or lint removal can hereby only be achieved by removing the coarse filter unit.

DE 44 03 183 C2 discloses a tumble dryer with a lint filter. The lint filter is arranged as a fixed, non-movable element in an air flow of the tumble dryer. For cleaning and/or to remove the lint on the lint filter a scraper is provided, which has a toothed drive rod on its side facing away from the ducting pipe. A drive pinion engages with the teeth of the drive rod and can be made to rotate by a gear system, when a toothed segment connected permanently to the loading door is moved as the loading door is opened. This causes the scraper to move over the surface of the lint filter facing the exhaust air and to scrape lint off it. Cleaning takes place here by automatic actuation of the scraper, when the loading door of the tumble dryer is opened. The removal of lint from the fixed lint filter is effected only very inadequately here too.

EP 1 050 619 B1 also discloses an automatically cleaned lint filter apparatus for domestic tumble dryers. The lint filter apparatus comprises a circulating element that circulates endlessly around two deflector elements and is arranged in an air flow. To remove the lint adhering to the circulating element, the circulating element is moved in the circulation direction and is made to pass a fixed scraper. When the process of cleaning the front region of the circulating element facing the air flow is completed, the rotational movement of the deflector elements is reversed, to that the front region of the circulating element (the region of the circulating element facing the air flow) returns to its original position. The cleaning process is very inadequate with this lint filter apparatus too and it is also very complex to carry out.

The object of the present invention is therefore to create a lint filter apparatus and a method for cleaning such a lint filter apparatus, which allow better lint removal with little outlay.

This object is achieved by a lint filter apparatus for an air flow in a tumble dryer, with an endlessly circulating element, which is arranged around at least two deflector elements and is positioned in such a manner that it is crossed by the air flow, with the circulating element having an upper edge and a lower edge, characterized in that first engaging elements are arranged at least on one of the two edges, which when a loading door of the tumble dryer is opened, can be brought into an active connection with at least a second engaging element, which is arranged inside the tumble dryer in such a manner that the process of opening the loading door means that the circulating element can be moved automatically in a circulation direction and can be made to pass a device for removing lint at least and a method for cleaning a lint filter apparatus for an air flow in a tumble dryer, which has a loading door, with the lint filter apparatus having at least two deflector elements, around which an endlessly circulating element is arranged, characterized in that when the loading door is opened, an active connection is generated between first engaging elements, which are arranged at least on an upper or a lower edge of the circulating element, and a second engaging element arranged inside the tumble dryer and the further process of opening the loading door causes the circulating element to be moved further automatically in a circulation direction due to the active connection existing between at least a first and the second engaging element and being made to pass a device for removing lint.

An inventive filter apparatus for an air flow in a tumble dryer has at least two deflector elements, around which an endlessly circulating element is arranged. The circulating element is positioned in such a manner that it is crossed by the air flow. The circulating element also has an upper edge and a lower edge. One important concept of the invention is that first engaging elements are arranged at least on one of the two edges, connecting actively in a mechanical manner with at least one second engaging element or being able to be coupled mechanically to this, when a loading door of the tumble dryer is opened, in such a manner that the further process of opening the loading door causes the circulating element to be able to be moved automatically in a circulation direction and to be able to be moved at least past a device for removing lint from the circulating element. The second engaging element is arranged inside the tumble dryer, in particular on the side of the loading door facing the inner compartment of the tumble dryer. According to the invention, the first and second engaging elements, which are uncoupled when the loading door is closed, are thus coupled mechanically when said loading door is opened and the further opening of the loading door causes lint to be removed from the circulating element, since with this further process of opening the loading door the circulating element can be made to move and thus scrapes past the at least one device for removing the lint.

The inventive lint filter apparatus allows a consistently optimal cleaning process to be achieved for the lint filter apparatus with little outlay and a high level of reliability. By coupling the opening process to a then automatic movement of the circulating element, lint is consistently removed in an efficient manner. In particular it can also mean that the further movement of the circulating element not only allows the side of the circulating element facing the air flow to be cleaned but also a different region of the circulating element to face the air flow for a subsequent drying process. This allows a constant alternating of the sub-regions of the circulating element, which face the air flow in successive drying processes. This can prevent excessive wear of the circulating element.

The first engaging elements are preferably configured as latching lugs. The second engaging element can advantageously be configured as rod-shaped and be hooked at its end facing the first engaging element. This means that two engaging elements are created that are very simple to produce and can be coupled reliably, ensuring the coupling and uncoupling and/or the generation of the mechanical active connection when the loading door is opened with little outlay and in a reliable manner. The engagement of the hooked end in a latching lug represents an uncomplicated coupling mechanism.

First engaging elements are advantageously configured both on the upper edge and on the lower edge of the circulating element and two second engaging elements are preferably positioned inside the tumble dryer in such a manner that one of the second engaging elements is configured to engage with the first engaging elements on the upper edge and one of the second engaging elements is configured to engage with the first engaging element on the upper edge of the circulating element. This means that uniform movement of the circulating element takes place constantly over the entire height of the circulating element and jamming of the circulating element is thus prevented. The wear that can occur when engagement takes place only at the upper edge or only at the lower edge can also thus be prevented.

This duplicated configuration also allows a redundant system to be created, which ensures certain and reliable further movement of the circulating element when the loading door is opened, even if a mechanical coupling is unexpectedly unsuccessful on the upper edge or on the lower edge between the first engaging element there and the assigned second engaging element.

The mechanical active connection is advantageously configured between the first and second engaging elements in such a manner that during the process of opening the loading door of the tumble dryer the circulating element can be moved further essentially through half the overall length of the circulating element. This means that after every second opening of the loading door the same sub-region of the circulating element is again arranged facing the air flow.

The device for removing lint is advantageously configured as a scraper or brush. Provision can also be made for at least two scrapers and/or brushes or at least one scraper and at least one brush to be arranged. The device for removing lint is preferably arranged essentially parallel to the deflector elements and is configured so that it can be moved in relation to the circulating element. The device for removing lint is hereby preferably configured as so large that its length corresponds to the height of the circulating element. This ensures that as the circulating element moves, the entire height between the upper and lower edges of the circulating element is covered by the device for removing lint and the lint in the entire region can be reliably removed. The ability of the device for removing lint to move in relation to the circulating element allows a further improvement to be achieved in the cleaning process. Specific movement of the device for removing lint in relation to the circulating element allows individual cleaning of the sub-region of the circulating element to be carried out specifically and reliably at particularly critical points.

The device for removing lint can preferably be moved counter to the circulation direction of the circulating element that can be brought about during the process of opening the loading door. This counter-movement of the circulating element and the device for removing lint allows particularly effective and efficient implementation of the process of cleaning the circulating element to be achieved.

The device for removing lint can be coupled to the second engaging element during the process of opening the loading door preferably in such a manner that the movement of the device for removing lint is brought about automatically by the process of opening the loading door. This means that the opening process, which has to be effected anyway, brings about both actuation of the circulating element and actuation of the device for removing lint automatically, in particular in opposing movement directions.

Provision can advantageously be made for the device for removing lint to be able to be moved over a cleaning device for cleaning the device for removing lint after a process of cleaning the circulating element. As a result the removal of lint from the device for removing lint can be achieved reliably in a consistent manner. The device for removing lint can thus be provided clean for each subsequent process of cleaning the circulating element, which also has a positive influence on the process of cleaning the circulating element.

The cleaning device is advantageously configured as a comb-type element. A lint collection region is advantageously configured on the inside of the loading door, in which lint collection region the lint removed by the cleaning device from the device for removing lint can be collected. This lint collection region can preferably have an aperture flap for the removal of lint from the lint collection region. Provision can also be made so that the lint collection region can be detached from the lint filter apparatus and can be removed from the tumble dryer.

The aperture flap can advantageously be actuated by way of an actuation element, with the actuation element being able to be arranged in the upper region of the panel of the loading door. In one advantageous embodiment the lint filter apparatus has a unit for identifying the fill level of the lint collection region, which is configured to indicate automatically, in particular by means of an optical and/or acoustic signal, if the lint collection region needs to be emptied. This means that it can be identified reliably when the lint collection region should be emptied. Overfilling and as a result blocking of the lint collection region can be prevented as a result.

A plastic element may be arranged between a front circulating region and a rear circulating region of the circulating element. The circulating element can be configured as a filter screen. The filter screen and plastic element can have different granularities here in respect of the passage of lint.

The deflector elements are advantageously arranged in an inner panel of the loading door. With the inventive method for cleaning a lint filter apparatus for an air flow in a tumble dryer, which has a loading door, with the lint filter apparatus comprising at least two deflector elements, around which an endlessly circulating element is arranged in a circulating manner, when the loading door is opened, a mechanical active connection is produced between first engaging elements, which are arranged at least on an upper or on a lower edge of the circulating element, and a second engaging element arranged inside the tumble dryer. The further process of opening the loading door causes the circulating element to be moved further automatically in a circulation direction due to the active connection existing between at least a first and the second engaging element and to pass a device for removing lint in such a manner that the lint is removed from the circulating element. Due to the coupling of the movement of the circulating element as a function of the process of opening the loading door, the inventive method allows removal of lint from the circulating element with little outlay and in a reliable manner.

The device for removing lint is advantageously moved automatically counter to the circulation direction of the circulating element during the process of opening the loading door. Because both the circulating element and the device for removing lint are moved, the cleaning of the circulating element can be improved further.

Advantageous embodiments of the lint filter apparatus can also be considered to be advantageous embodiments of the inventive method.

DETAILED DESCRIPTION OF THE DRAWINGS

The invention is described in more detail below with reference to schematic drawings, in which.

Identical elements or elements of identical function are shown with identical reference characters in the figures.

Figure 1:
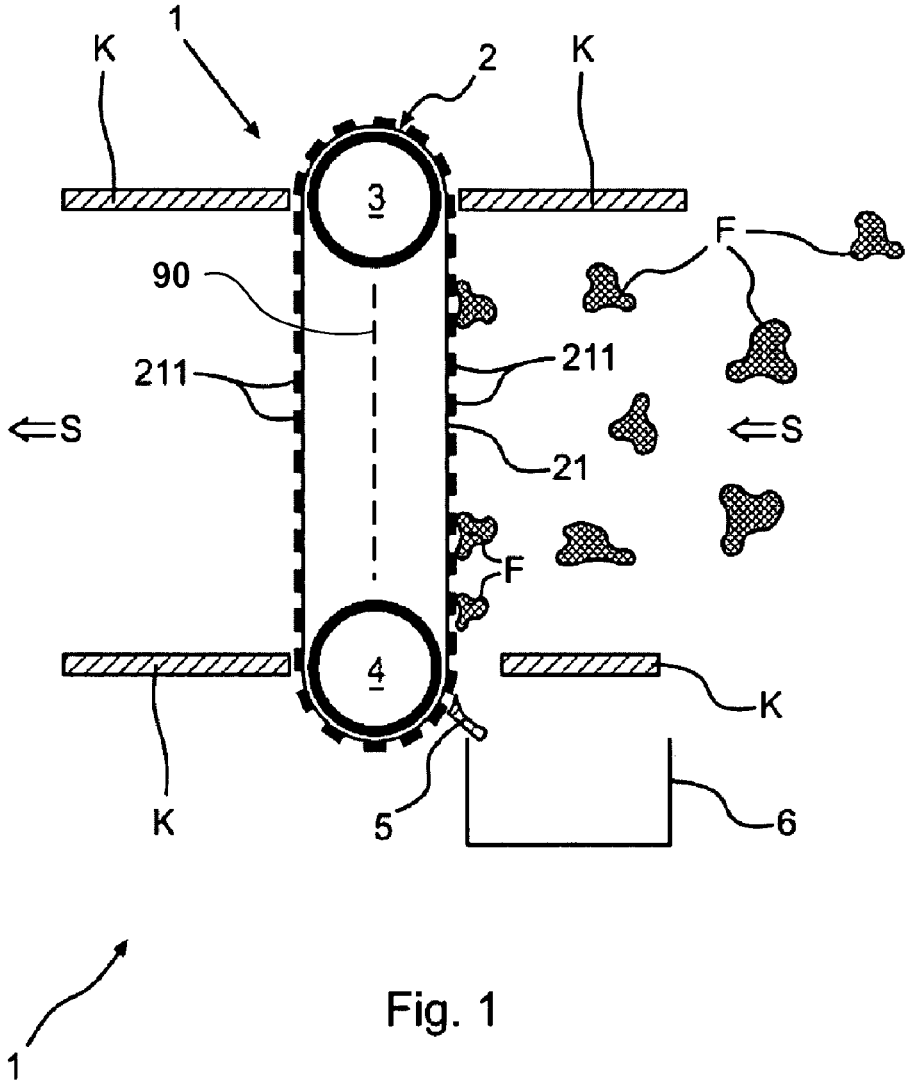
FIG. 1 shows a top view of an inventive lint filter apparatus.

The schematic top view in FIG. 1 shows a lint filter apparatus 1, which is arranged in a tumble dryer (not shown). The lint filter apparatus 1 is arranged in an air flow S, in such a manner that the air flow S crosses the lint filter apparatus 1. In the exemplary embodiment the lint filter apparatus 1 is aligned essentially perpendicular to the air flow S.

The air flow S of the tumble dryer is generally guided over the laundry to be dried in the tumble dryer, with the air flow S drawing moisture from the laundry and possibly taking with it lint F, which can be deposited elsewhere in the tumble dryer and therefore must be removed. The air flow S carrying the lint F enters the lint filter apparatus 1 from the right in the exemplary embodiment in FIG. 1 and is guided horizontally and in a straight line in an air duct K. The lint filter apparatus 1 has an endlessly circulating element 2, which is configured as an endless belt in the exemplary embodiment. In the exemplary embodiment this circulating element 2 is held and tensioned by two deflector elements 3 and 4, with the circulating element 2 being arranged across the air flow S in such a manner that the tensioned regions (in FIG. 1 vertically aligned regions of the circulating element 2) are held essentially perpendicular to the air flow S.

The deflector elements 3 and 4 are supported in such a manner that they can be rotated, with at least one of these two deflector elements 3 and 4 being able to be driven clockwise or counter-clockwise.

The circulating element 2 has a lower edge (not shown) and an upper edge 21. In the exemplary embodiment first engaging elements 211 are arranged both on the lower edge and on the upper edge 21. As shown, in the exemplary embodiment in FIG. 1 a number of these first engaging elements 211 are arranged at intervals from each other around the entire upper edge 21. The first engaging elements 211, shown schematically as black rectangles, are configured as latching lugs in the exemplary embodiment. Such latching lugs are also configured correspondingly on the lower edge of the circulating element 2.

A device 5 for removing lint F from the upper side of the circulating element 2 is also arranged schematically. This device 5 for removing lint F is arranged in a movable manner in the exemplary embodiment and is configured in particular so that it can be moved in relation to the circulating element 2.

It can be seen from FIG. 1 that a lint collection region 6 is configured. After a process of cleaning the circulating element 2 the device 5 for removing lint F can be arranged so that it can be moved over a cleaning device (not shown) for cleaning the device 5 and can be moved over this cleaning device in such a manner that the lint F collected in the device 5 can be removed and can be collected by the cleaning device, which can be configured as a comb-type element, in the lint collection region 6. Device 5 can be configured as a brush.

In the exemplary embodiment the lint filter apparatus 1, the device 5 and the lint collection region 6 are all arranged on the inside of a loading door (not shown) of the tumble dryer.

In the exemplary embodiment the deflector elements 3 and 4 are arranged essentially parallel to each other and are configured as cylindrical. The longitudinal axes of the deflector elements 3 and 4 are arranged perpendicular to the plane of the figure.

The circulating element 2 is configured at least partially from a filter screen, which can be a wide-mesh network of thin smooth threads.

The first engaging elements 211 are mechanically uncoupled in the diagram shown in FIG. 1 or are arranged with no mechanical active connection to second engaging elements (not shown), which are arranged inside the tumble dryer in the exemplary embodiment.

Figure 2:
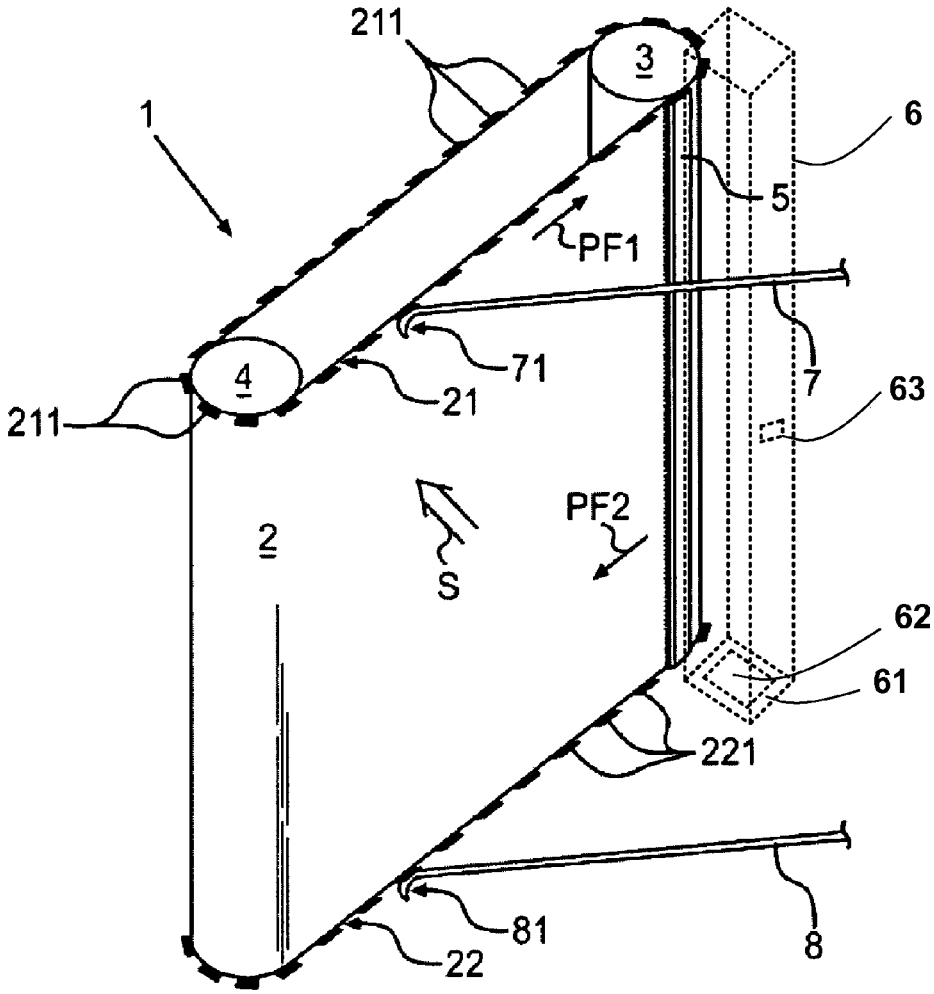
FIG. 2 shows a perspective view of an inventive lint filter apparatus.

The mode of operation of the inventive filter device 1 is described below using the perspective view in FIG. 2. It can be seen there that the circulating element 2 also has first engaging elements 221 on its lower edge 22. FIG. 2 also shows the two second engaging elements 7 and 8 in the exemplary embodiment in a schematic manner. As shown, these second engaging elements 7 and 8 are configured as rod-shaped and have hooked ends 71 and/or 81 in their end regions facing the first engaging elements 211 and/or 221. A mechanical coupling between the second engaging elements 7 and 8 and the first engaging elements 211 and 221 can be produced by way of these hooked ends 71 and 81.

When the tumble dryer is in the closed state, the loading door of the tumble dryer is also closed. In this closed state the first engaging elements 211 and 221 have no active connection and therefore no mechanical coupling to the second engaging elements 7 and 8. If the loading door is then opened, engagement and therefore a mechanical active connection between the hooked end 71 and one of the first engaging elements 211 is produced automatically on the upper edge 21 of the circulating element 2. Similarly a mechanical coupling between the hooked end 81 of the second engaging element 8 and a first engaging element 221 is produced on the lower edge 22 of the circulating element 2. This engagement or mechanical active connection is produced as soon as the loading door is opened. If the loading door is then opened further in a further opening process, the lint filter apparatus 1 is configured in such a manner that the circulating element 2 is moved in the direction of the arrow PF1 in the exemplary embodiment. This happens as a result of the second engaging elements 7 and 8 and in particular the hooked ends 71 and 81 being moved in this direction by the process of opening the loading door. The mechanical coupling between the second engaging elements 7 and 8 and the first engaging elements 211 and 221 then causes the circulating element 2 also to move automatically in the direction of the arrow PF1 due to the process of opening the loading door.

In the exemplary embodiment during a process of opening the loading door, which goes from a minimum opening to a maximum possible opening of the loading door, the circulating element 2 is moved further essentially through half its overall length. This means that during such an opening process the sub-region of the circulating element 2 originally facing the air flow S is moved almost completely backward and is thus positioned on the side facing away from the air flow S, when the loading door is fully opened.

FIG. 2 shows the device 5 for removing lint F arranged adjacent to the deflector element 3. As shown in the diagram in FIG. 2 the device 5 extends at least over the entire height of the circulating element 2. The height of the circulating element 2 is hereby defined by the extent of the circulating element 2 between the upper edge 21 and the lower edge 22. In the exemplary embodiment this device 5 is configured so that it can be moved in relation to the circulating element 2. The device 5 is likewise connected actively to the process of opening the loading door in such a manner that while the loading door is being opened from a minimum opening position to a maximum opening position, movement takes place in the direction of the arrow PF2. In the exemplary embodiment this mechanical coupling is such that during this process of opening the loading door the device 5 is moved completely from the state shown in FIG. 2 to a corresponding position adjacent to the deflector element 4. The device 5 is thus moved over the entire path between the deflector element 3 and the deflector element 4 in the direction of the arrow PF2. In the exemplary embodiment the process of opening the loading door therefore automatically brings about a counter movement between the circulating element 2 and the device 5. Because the device 5 is in contact with this circulating element 2 at least during movement of the circulating element 2, the lint collected on the upper side of the circulating element 2 is removed.

In the exemplary embodiment the possibility of movement of the device 5 in the arrow direction PF2 and also in the counter direction according to the arrow PF1 is such that is can be moved outward over the arrangement of the deflector elements 3 and 4. A cleaning device (not shown) is arranged on the side of the deflector element 4 facing away from the deflector element 3, being a comb-type element in the exemplary embodiment. A further such comb-type element is also positioned in a similar manner on the side of the deflector element 3 facing away from the deflector element 4. By moving the device 5 over these comb-type elements it is possible to scrape off the lint that has collected in the device 5. The lint falling off this comb-type element then passes to the lint collection region 6 (FIG. 1) and is collected there.

This lint collection region 6 has an aperture, configured in the exemplary embodiment on the underside or bottom 61 (FIG. 2) of the lint collection region 6. This aperture, which can be configured as a flap 62, can be actuated in the exemplary embodiment by an actuation element (not shown), which can be arranged in the upper region of the panel of the loading door. The actuation element can be a pushbutton for example. The lint F collected in the lint collection region 6 then drops out and into a container provided, for example a trash can.

In the exemplary embodiment the tumble dryer has a unit 63, for example a sensor, which is used to monitor the fill level of the lint collection region 6 and which can be used to indicate a possible overflow state in good time optically and/or acoustically. This signals that the lint collection region 6 should soon be emptied. Provision can hereby be made for this to happen perhaps every ten drying processes and such a warning to be generated perhaps after ten drying processes. Of course this number is by way of example and can differ substantially for example depending on the size of the lint collection region 6.

Provision can also be made for a plastic wall 90 to be positioned between the front (side facing the air flow S) and the rear (side facing away from the air flow S) of the circulating element. This can be used to direct the air from which the lint has been removed back inside the tumble dryer.

The number, arrangement and shape of the first engaging elements 211 and 221 and also the second engaging elements 7 and 8 are all simply shown by way of example in FIGS. 1 and 2, to clarify the invention, and can be realized in many different ways. All these embodiments are similarly covered by the invention. It is important that the process of opening a loading door allows automatic movement of the circulating element 2 and advantageously also the device 5 for removing lint F to be generated.

The invention claimed is:

1. A lint filter apparatus for an air flow stream in a tumble dryer, the lint filter apparatus comprising:

an circulating element formed as an endless belt having an upper edge and a lower edge, the circulating element being disposed in the air flow stream for collecting matter traveling in the air flow stream;

a pair of deflector elements having the circulating element trained therearound;

a plurality of first engaging elements disposed on at least one of the upper edge and the lower edge of the circulating element;

a second engaging element that can be engaged with a door of the tumble dryer such that the second engaging element is moved into and out of engagement with one of the first engaging elements for moving the circulating element when the door is opened; and a lint removing device for engagement with the circulating element for removing lint therefrom when the circulating element is moved.

2. The lint filter apparatus according to claim 1 wherein the at least one first engaging element is configured as a latching lug.

3. The lint filter apparatus according to claim 1 wherein the at least one second engaging element is configured as a rod-shaped member having a hook formed at a distal end thereof and facing a first engaging element.

4. The lint filter apparatus according to claim 1 wherein the first engaging elements are disposed on both the upper edge of the circulating element and the lower edge of the circulating element and two second engaging elements are arranged inside the tumble dryer, with one of the second engaging elements being configured to engage the first engaging elements on the upper edge of the circulating element and one of the second engaging elements being configured to engage the first engaging elements on the lower edge of the circulating element.

5. The lint filter apparatus according to claim 1 wherein the first and second engaging elements are configured for engagement in such a manner that during the process of opening the loading door of the tumble dryer the circulating element can be moved through a distance substantially equal to half the overall length of the circulating element.

6. The lint filter apparatus according to claim 1 wherein the device for removing lint is formed as a brush disposed substantially parallel to the deflector elements and configured for movement relative to the circulating element.

7. The lint filter apparatus according to claim 6 wherein the device for removing lint is configured for movement in a manner counter to the circulation direction of circulating element movement during the process of opening the loading door.

8. The lint filter apparatus according to claim 7 wherein the device for removing lint is configured for coupling to the second engaging element during the process of opening the loading door in a manner wherein the device for removing lint is moved by the door opening process.

9. The lint filter apparatus according to claim 6 wherein the device for removing lint is configured for movement over a cleaning device for cleaning the device for removing lint after a process of cleaning the circulating element.

10. The lint filter apparatus according to claim 9 wherein the cleaning device is configured as a toothed element.

11. The lint filter apparatus according to claim 9 wherein a lint collection region is configured on the inside of the loading door for collecting lint removed by the cleaning device.

12. The lint filter apparatus according to claim 11 and further comprising a flap disposed in the lint collection region for removing the lint therefrom.

13. The lint filter apparatus according to claim 12 and further comprising an actuation element disposed in an upper region of the panel of the loading door for actuating the flap.

14. The lint filter apparatus according to claim 11 and further comprising a fill level detection unit configured to identify a filling condition of the lint collection region, the fill level detection unit being configured to indicate a predetermined fill level of the lint collection region using one of an optical signal, an acoustic signal and a combined signal including an optical signal and an acoustic signal.

15. The lint filter apparatus according to claim 1 and further comprising a wall element disposed intermediate a front region and a rear region of the circulating element for directing air from which the lint has been removed back inside the tumble dryer.

16. The lint filter apparatus according to claim 1, wherein the circulating element is configured at least partially as a filter screen.

17. The lint filter apparatus according to claim 1 wherein the at least two deflector elements are disposed in an inner panel of the loading door.

18. A method for cleaning a lint filter apparatus for an air flow in a tumble dryer having a loading door, the method comprising the steps of:

providing a lint filter apparatus having an circulating element formed as an endless belt having an upper edge and a lower edge, the circulating element being disposed in the air flow stream for collecting matter traveling in the air flow stream;

at least two deflector elements having the circulating element trained therearound;

a plurality of first engaging elements disposed on at least on one of the upper edge and the lower edge of the circulating element; at least one second engaging element operatively engaged with a door of the tumble dryer for movement therewith into and out of engagement with at least one first engaging element for moving the circulating element when the door is opened; and a lint removing device for engagement with the circulating element for removing lint therefrom when the circulating element is moved; opening the loading door thereby engaging the second engaging elements with the first engaging elements causing the circulating element to move and the lint removing device to engage the circulating element to remove lint therefrom.

19. The method according to claim 18, wherein the step of opening the loading door causes the device for removing lint to be moved automatically in a direction counter to the movement direction of the circulating element during the process of opening the loading door.

20. A lint filter apparatus for an air flow stream in a tumble dryer, the lint filter apparatus comprising:

a circulating element formed as an endless belt having an upper edge and a lower edge, the circulating element being disposed in the air flow stream for collecting matter traveling in the air flow stream;

a pair of deflector elements having the circulating element trained therearound;

a plurality of first engaging elements disposed on at least one of the upper edge and the lower edge of the circulating element;

a second engaging element adapted to be engaged with a door of the tumble dryer such that the second engaging element is automatically moved into engagement with one of the first engaging elements by the door being moved from a closed position to an open position, the engagement of the second engaging element with one of the first engaging elements and further motion of the second engaging element causing the circulating element to move when the door is moved from the closed position to the open position; and a lint removing device that engages the circulating element for removing lint therefrom when the circulating element is moved.

* * * * *